US006191351B1

(12) United States Patent
Niitsuma

(10) Patent No.: US 6,191,351 B1
(45) Date of Patent: Feb. 20, 2001

(54) COMPOSITE PART FOR ELECTRONIC MUSICAL INSTRUMENT

(75) Inventor: Shinji Niitsuma, Shizuoka-ken (JP)

(73) Assignee: Kabushiki Kaisha Kawai Gakki Seisakusho, Hamamatsu (JP)

( * ) Notice: Under 35 U.S.C. 154(b), the term of this patent shall be extended for 0 days.

(21) Appl. No.: 09/629,183

(22) Filed: Jul. 31, 2000

(30) Foreign Application Priority Data

Jul. 30, 1999 (JP) ..... 11-217875

(51) Int. Cl.[7] ..... G10H 1/34
(52) U.S. Cl. ..... 84/720; 84/423 R; 84/438
(58) Field of Search ..... 84/236, 243, 246, 84/423 R, 438, 720, 745

(56) References Cited

U.S. PATENT DOCUMENTS 5,249,497 * 10/1993 Niitsuma .
5,894,099 * 4/1999 Niitsuma .
5,932,820 * 8/1999 Kihara ..... 84/216
5,986,202 * 11/1999 Seiler ..... 84/423 R X

FOREIGN PATENT DOCUMENTS 7-38720 7/1995 (JP) .

* cited by examiner

*Primary Examiner*—Jeffrey Donels
(74) *Attorney, Agent, or Firm*—Evenson, McKeown, Edwards & Lenahan, P.L.L.C.

(57) ABSTRACT

A composite part for an electronic musical instrument which allows the center of a drill to be immediately and reliably positioned on a rivet during disassembly, thereby making it possible to significantly improve the efficiency of disassembling works and accordingly promote reuse of resources. The composite part is composed of first and second members each having a rivet inserting hole, and a rivet having a head and a shaft. The rivet is inserted through the rivet inserting holes of the first and second members, and a leading end portion of the shaft is caulked to join the first and second members together. The rivet is formed with a guiding recess formed on a surface of at least one of the head and the caulked leading end portion of the shaft for guiding a drill for cutting the rivet when the first and second members are disassembled.

3 Claims, 4 Drawing Sheets

COMPOSITE PART FOR ELECTRONIC MUSICAL INSTRUMENT

BACKGROUND OF THE INVENTION

1. Field of the Invention

The present invention relates to a composite part for an electronic musical instrument which is composed of a plurality of members joined together by a rivet.

2. Description of the Related Art

A composite part directed by the present invention may be used, for example, as a hammer in a keyboard-based musical instrument such as an electronic piano. The hammer is adapted to pivot in association with a corresponding key depressed on a keyboard to provide a touch feeling similar to that of an acoustic piano. The hammer is typically composed of a hammer body made of synthetic resin or the like, a weight attached to the hammer body for controlling key touch, and so on. Conventionally, the weight is formed of a lead-made cylinder having a predetermined weight, which is inserted into an attaching hole formed at a predetermined position of the hammer body, caulked, and laterally swelled to be attached to the hammer body. Since such a hammer is composed of the hammer body and the weight made of different materials from each other, i.e., synthetic resin and lead, the two components are preferably disassembled, when the keyboard musical instrument is disposed, from a view point of reusing resources. However, since the hammer has the weight fully embedded in the attaching hole of the hammer body, the disassembly of the hammer body and the weight presents extreme difficulties. In addition, the lead itself comprising the weight is deleterious to the environment.

For this reason, as a recent hammer for replacement with the conventional lead-based weight, there is known a hammer which uses a weight made of an iron plate or the like and formed with a rivet inserting hole, and a hammer body also formed with a rivet inserting hole, such that a rivet is inserted through the two rivet inserting holes and the leading end portion of the rivet is caulked to attach the weight to the hammer body. With this hammer, since the head of the rivet and the caulked leading end portion protrude from the hammer body, the hammer can be readily disassembled by cutting the head or the leading end portion of the rivet with an electric drill.

The foregoing hammer, however, has the head and the leading end portion, the surfaces of which are planar or curved, so that, a drill, when in contact with the head or the leading end portion for disassembling the hammer, is susceptible to slippage, and therefore is difficult in positioning the center thereof, resulting in inefficient disassembling works.

OBJECT AND SUMMARY OF THE INVENTION

The present invention has been made to solve the problem mentioned above, and its object is to provide a composite part for an electronic musical instrument which allows the center of a drill to be immediately and reliably positioned on a rivet to significantly improve the efficiency of disassembling works and to promote reuse of resources.

To achieve the above object, the present invention provides a composite part for an electronic musical instrument which comprises first and second members each having a rivet inserting hole, and a rivet having a head and a shaft. The rivet is inserted through the rivet inserting holes of the first and second members, and a leading end portion of the shaft is caulked to join the first and second members together. The rivet includes a guiding recess formed on a surface of at least one of the head of the rivet and the caulked leading end portion of the shaft of the rivet for guiding a drill for cutting the rivet when the first and second members are disassembled. The guiding recess is formed simultaneously with the caulking of the rivet.

According to this composite part, when the rivet is cut with an electric drill for disassembling the composite part, the center of the drill can be guided by the guiding recess formed on the surface of the head and/or the leading end portion of the rivet to immediately and reliably position the drill without slippage on the rivet. This results in an improved efficiency of works for disassembling the composite part and accordingly promotion of reuse of resources. Also, since the guiding recess is formed simultaneously with the caulking of the rivet, a separate machining step for forming the guiding recesses is not required either before or after the caulking of the rivet, thereby making it possible to reduce the number of assembling steps and accordingly the assembling cost.

Preferably, the first and second members may be made of materials different from each other.

When the composite part is composed of members made of different materials, it is highly demanded to disassemble such composite parts, when the electronic piano is disposed, from a view point of reuse of resources. The structure described above allows for highly efficient disassembly even when the first and second members are made of different materials, and particularly contributes to the reuse of resources.

Also preferably, the composite part is a hammer provided for each key of an electronic piano, the first member comprises a hammer body made of synthetic resin, and the second member comprises a weight made of iron for adding a weight to the hammer body.

In this structure, a large number of hammers, provided one per key in the electronic musical instrument, can be efficiently disassembled into synthetic resin and iron, both of which are highly reusable as resources, thereby maximizing the advantage of the present invention. In addition, since the weight is made of iron, it is not deleterious to the environment, unlike conventionally used lead.

DESCRIPTION OF THE PREFERRED EMBODIMENTS

The present invention will hereinafter be described in detail in conjunction with preferred embodiments thereof with reference to the accompanying drawings.

Figure 1:
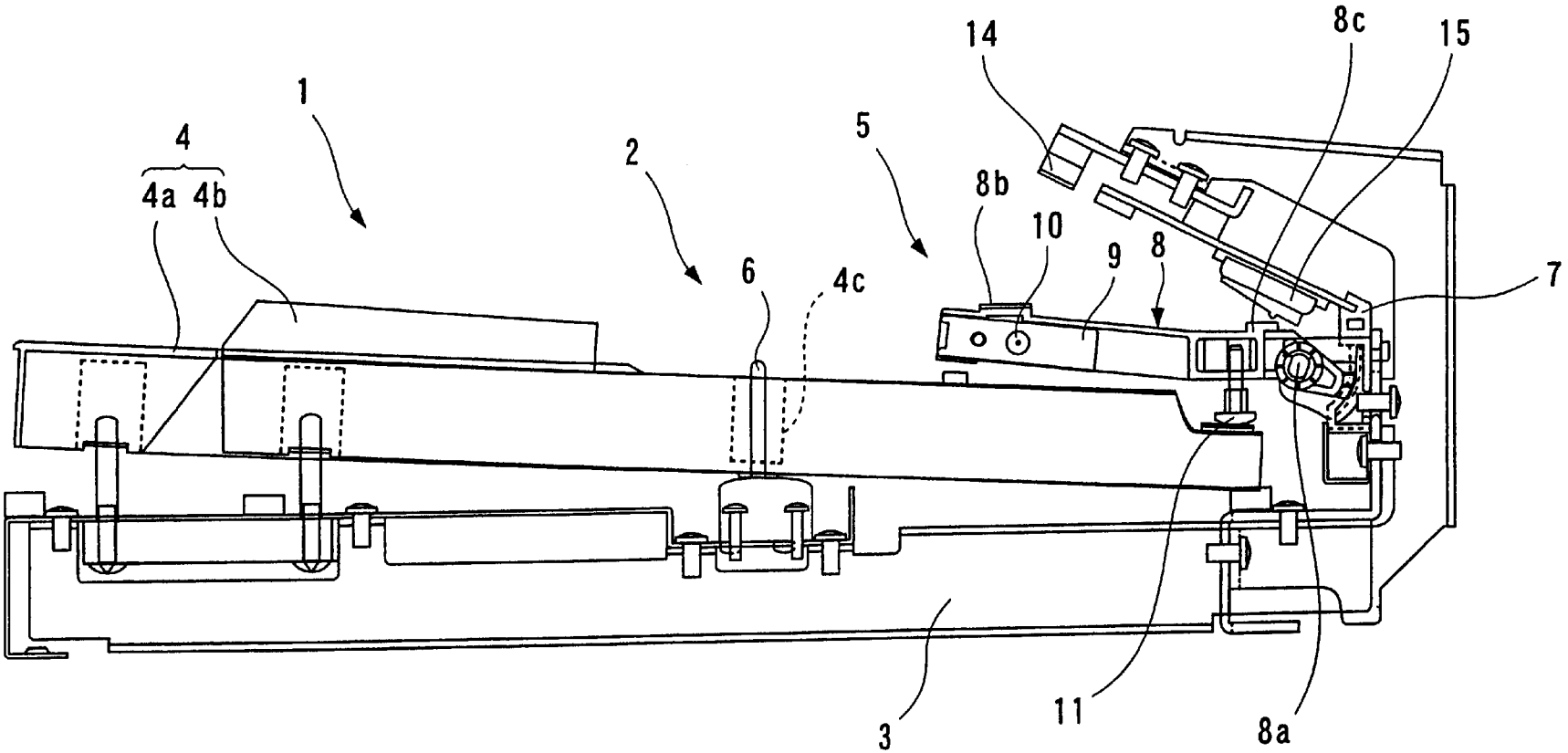
FIG. 1 is a cross-sectional view illustrating a keyboard unit of an electronic piano including a hammer according to a first embodiment of the present invention.

FIG. 1 illustrates a keyboard unit of an electronic piano including hammers (composite part) according to a first embodiment of the present invention.

The illustrated keyboard unit 2 of the electronic piano 1 comprises a chassis 3, a number of keys 4 attached thereto, hammers 5, and so on. The chassis 3 is made of a metal plate such as an iron plate by die-stamping and bending the same using a press. A balance pin 6 is implanted in a central region of the chassis 3 in the longitudinal direction. The key 4, similar to that of an acoustic piano, is made of wood, and composed of a white key 4*a* and a black key 4*b*. The key 4 is pivotally supported by the balance pin 6 through a balance pin hole 4*c* formed through a central portion thereof.

Figure 2:
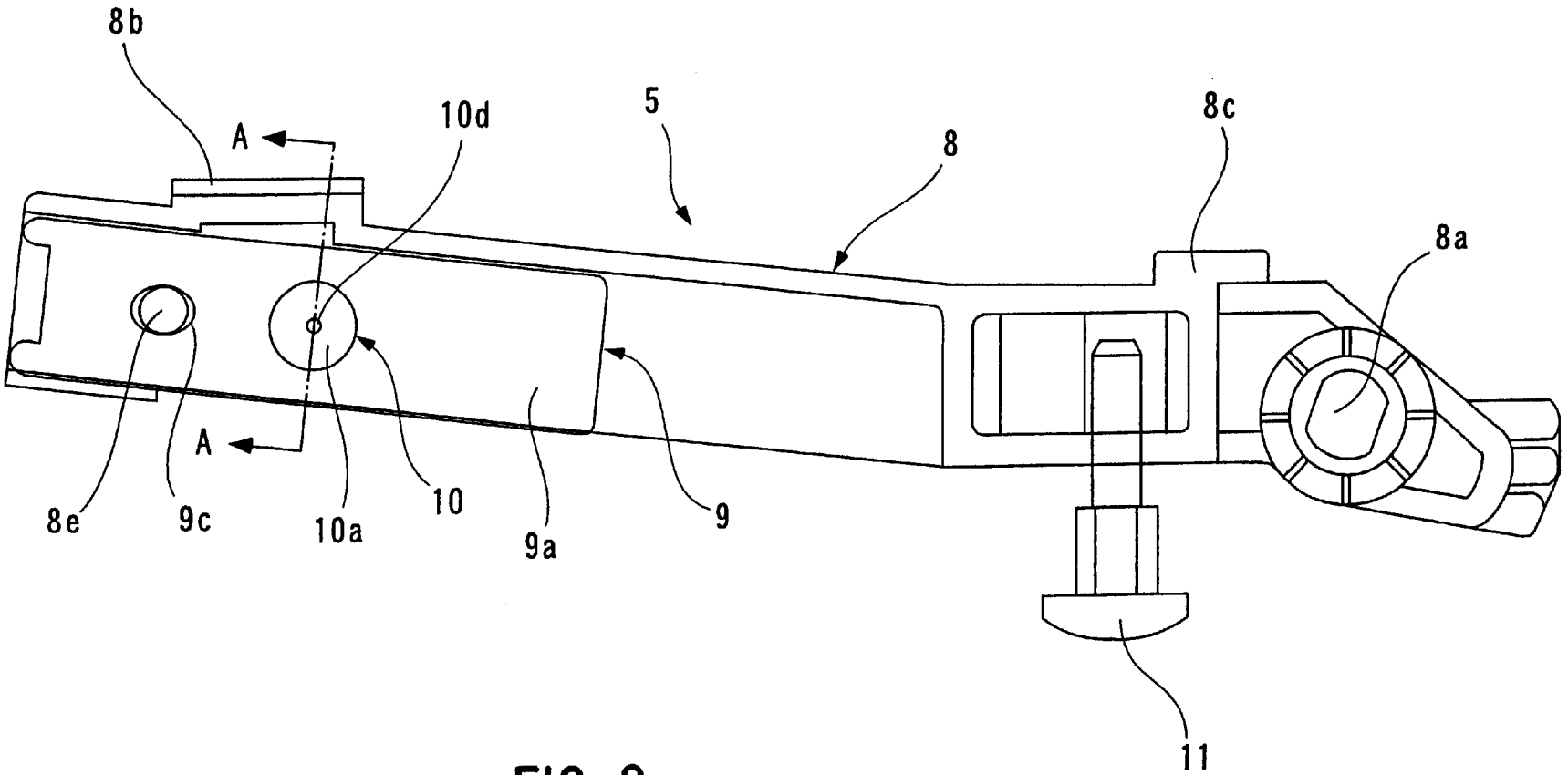
FIG. 2 is a lateral view of the hammer shown in FIG. 1.

The hammer 5, which is provided for each key 4, has its rear end pivotally supported by a fulcrum member 7 attached to the chassis 1. As illustrated in FIGS. 2 and 3, the hammer 5 comprises a hammer body 8 (first member) extending in the longitudinal direction; a weight 9 (second member) fixed in the former half of the hammer body 8; a rivet 10 for fixing the weight 9 on the hammer body 8; and an adjusting screw 11 arranged in a rear end portion of the bottom surface of the hammer body 8.

The hammer body 8 may be a molding made of synthetic resin such as ABS, and rectangular in cross-section. The hammer body 8 is integrally formed with a supported protrusion 8*a* positioned in a rear end portion and extending from both side surfaces, engaged with and supported by the fulcrum member 7; a cushion contact salient 8*b* in a front end portion of the top surface; and an actuator portion 8*c* in a rear end portion of the top surface. The hammer body 8 is narrower in a front portion which is formed with a rivet inserting hole 8*d* extending therethrough in the lateral direction at a predetermined position, and with pin-like positioning protrusions 8*e* (only one of which is illustrated) extending from both sides in front of the rivet inserting hole 8*d*.

The weight 9 is provided for adding a required weight to the hammer body 8, and is composed, for example, two iron plates 9*a* having a predetermined weight and length. Each of the iron plate 9*a* is formed at the center thereof with a rivet inserting hole 9*b*, corresponding to the rivet inserting hole 8*d* of the hammer body 8, extending therethrough in the lateral direction. In front of the rivet inserting hole 9*b*, a slightly elongated positioning hole 9*c* is formed corresponding to the positioning protrusions 8*e* of the hammer body 8.

Figure 3A:
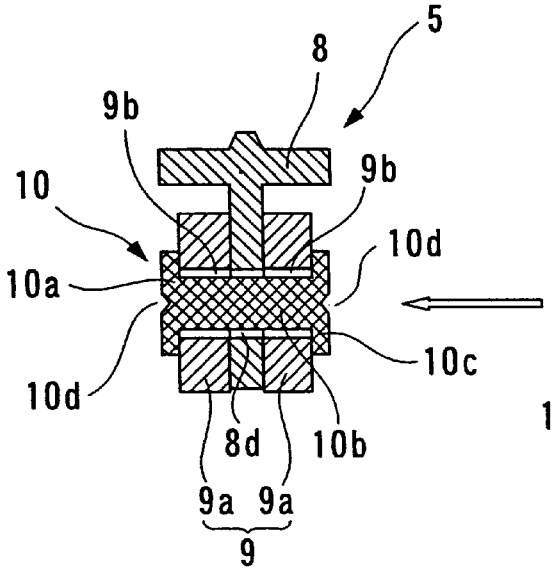
FIG. 3A is a cross-sectional view taken along a line A—A in FIG. 2.
Figure 3B:
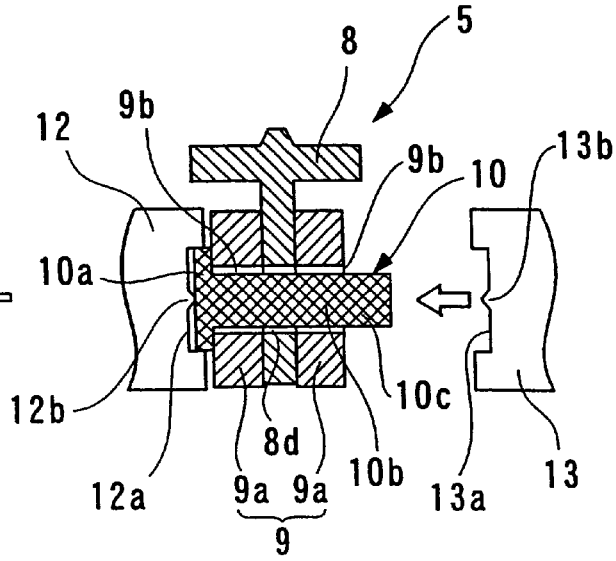
FIG. 3B is a cross-sectional view showing how the hammer and a weight are riveted together.

A rivet 10 may be a flat rivet having a thin flat head 10*a* and a shaft 10*b*. As illustrated in FIGS. 3A and 3B, two iron plates 9*a* and the hammer body 8 are joined by the rivet 10. More specifically, the positioning protrusions 8*e* of the hammer body 8 are engaged in the positioning holes 9*c* of the respective iron plates 9*a* to position the iron plates 9*a* on both side surfaces of the hammer body 8. Then, the shaft 10*b* of the rivet 10 is inserted through the rivet inserting holes 9*b*, 8*d*, 9*b*, aligned in the above-mentioned state, from one side. A leading end portion 10*c* of the shaft 10*b* extending from the other side is caulked using a hard patch 12 and a snap 13 to rivet the respective iron plates 9*a* and the hammer body 8.

The dies 12*a*, 13*a* associated with the hard patch 12 and the snap 13, have the same predetermined shape. Specifically, the bottom is flat and formed with a lug at the center. Thus, as can be seen in FIG. 3A, after riveting, the rivet 10 is such that the leading end portion 10*c* of the caulked shaft 10*b* has the same flat shape as the head 10*a*, and guiding recesses 10*d* (see FIG. 2) corresponding to the lugs 12*b*, 13*b* of the hard patch 12 and the snap 13 are formed at the center of the head 10*a* and leading end portion 10*c*. The guiding recesses 10*d* serve to guide a drill when the rivet 10 is cut with an electric drill for disassembling the hammer 5 in the event the electronic piano 1 is disposed, later described.

The hammer 5 configured as described above is pivotally supported by the fulcrum member 7 through the supported protrusion 8*a*. Also, the hammer 5 is carried on the top surface of the key 4 in a rear end portion through the adjusting screw 11, such that the height of the hammer 5 is adjusted by advancing or retracting the adjusting screw 11. When depression on the key 4 causes the hammer 5 having a predetermined weight to pivot upward, the cushion contact surface 8*b* comes into contact with an overlying cushion 14, resulting in key touch and touch feeling similar to those of an acoustic piano. Also, as the hammer 5 is pivoted, the actuator portion 8*c* urges a key switch 15 positioned above to detect information on the depression on the key 4.

According to the hammer 5 configured as described above, when the electric piano 1 is disposed in future, the rivet 10 is cut with an electric drill for disassembly with the center of a drill guided by the guiding recesses 10*d* formed on the surfaces of the head 10*a* and the caulked leading end portion 10*c* of the rivet 10, so that the center of the drill can be immediately and reliably positioned without slippage on the rivet 10. This result in an improved efficiency of works for disassembling the hammer 5 into the hammer body 8 and the weight 9 and promoted reuse of the resources. Particularly, since a large number of hammers 5 are provided, one per key 4, in the electronic piano 1, the entire work time required for the disassembly can be largely reduced.

In addition to the disassembly of the hammer 5 into the hammer body 8 and the weight 5, which are made of different materials from each other, the constituent synthetic resin and iron are highly reusable as resource, thus contributing largely to reuse of resource. Further, since the weight 9 is made of the iron plate 9*a*, it is not deleterious to the environment, unlike the conventional lead. Furthermore, since the guiding recesses 10*d* are formed simultaneously with the caulking of the rivet 10, a separate machining step for forming the guiding recesses is not required either before or after the caulking of the rivet 10, thereby making it possible to reduce the number of assembling steps and accordingly the assembling cost.

Figure 4:
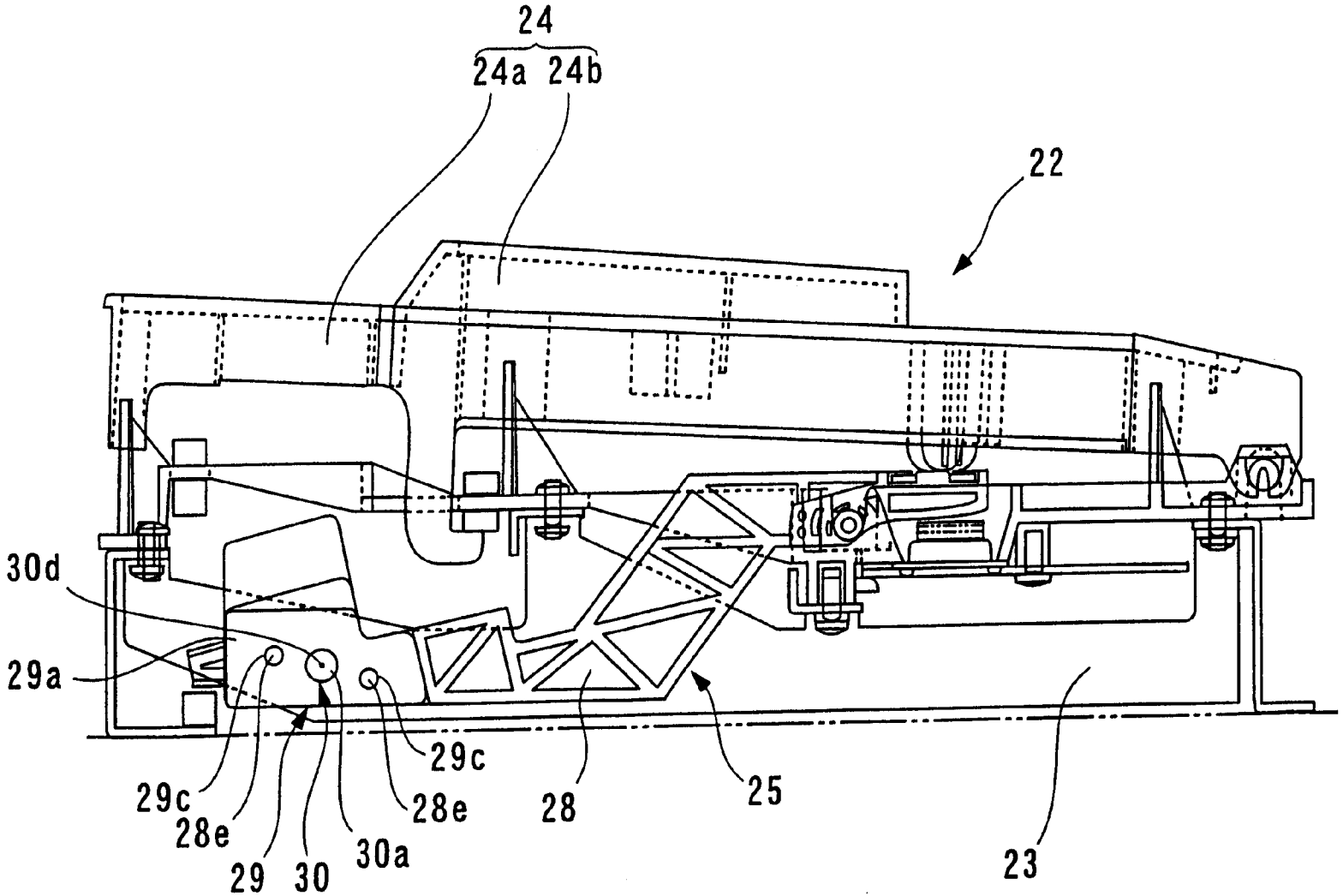
FIG. 4 is a cross-sectional view illustrating a keyboard unit of an electronic piano including a hammer according to a second embodiment of the present invention.

FIG. 4 illustrates a keyboard unit of an electronic piano of a different type which includes hammers according to a second embodiment of the present invention. The illustrated keyboard unit 22 comprises a number of keys 24 pivotally attached to a chassis 23, and hammers 25. Each key 24 (composed of a white key 24*a* and a black key 24*b*) is made of synthetic resin such as AS, unlike the wood-made key 4 of the first embodiment.

The hammer 25 in turn is composed of a hammer body 28 of a molding made of synthetic resin such as ABS; a weight 29 fixed in a front end portion of the hammer body 28; and a rivet 30 for fixing the weight 29 to the hammer body 28, similar to the hammer 5 of the first embodiment. The hammer body 28 has a curved shape with a rear end portion being pivotally supported by the chassis 23 and extending forwardly below the chassis 23. The weight 29 is composed of two iron plates 29*a* (only one of which is illustrated) having a predetermined weight, like the weight 9 of the first embodiment, and has a shape conformal with a front side portion of the hammer body 28.

The iron plates 29*a* are joined to both side surfaces of the hammer body 28 with the rivet 30 in a manner similar to the first embodiment. More specifically, positioning holes 29*c* of the respective iron plates 29*a* are engaged with left and right positioning protrusions 28*e*, formed on the respective side surfaces of the hammer body 28, to position the iron plates

29*a* on both side surfaces of the hammer body 28, and the rivet 30 is inserted through rivet inserting holes (not shown) of the hammer body 28 and the respective iron plates 29*a* which are put together in the state mentioned above. Then, these components are riveted using a hard patch and a snap (both not shown) similar to those used in the first embodiment. In this way, the hammer body 28 and the iron plates 29*a* are joined together, and simultaneously a head 30*a* and a leading end portion (not shown) of a shaft of the rivet 30 are formed with guiding recesses 30*d* for guiding a drill which may be used when the hammer 25 is disassembled. With the structure described above, the second embodiment can also produce completely the same effects of the aforementioned first embodiment.

It should be understood that the present invention is not limited to the specific embodiments described above, but may be practiced in various manners. For example, while in the two embodiments, the hammer is composed of the hammer body made of synthetic resin and the weight made of iron plate, these components may be of course made of other suitable materials. Also, while the guiding recesses of the rivet are formed simultaneously with the caulking of the rivet, the guiding recesses may be previously formed before the caulking, or may be formed after the caulking. Further alternatively, the guiding recess may be formed only on the head or the caulked leading end portion.

Further, while the foregoing embodiments have been described for a hammer of an electronic piano by way of example, the present invention is not limited to such a specific part, but may be widely applied to a composite part composed of two or more members for other keyboard-based musical instruments, and a composite part for the fields other than the keyboard-based musical instruments. For example, other composite parts in a keyboard-based musical instrument may be a key when a key weight is attached to a key body; a damper lever composed of a damper lever body and a weight for stopping sound after an associated key is released in a ground piano; and so on. Furthermore, the present invention can be of course applied to a fixed composite part, not pivotally movable, as well as a composite part composed of a pivotal member and a weight for adding a weight thereto as described above. Other changes and modifications may also be made in details of the structure as required without departing from the scope of the present invention.

As described above, the composite part for an electronic musical instrument according to the present invention allows the center of a drill to be immediately and reliably positioned on the rivet during disassembly, thereby making it possible to significantly improve the efficiency of disassembling works and accordingly promote reuse of resources.

What is claimed is:

1. A composite part for an electronic musical instrument comprising:

first and second members each having a rivet inserting hole; and a rivet having a head and a shaft, said rivet being inserted through said rivet inserting holes of said first and second members, and a leading end portion of said shaft being caulked to join said first and second members together, said rivet including a guiding recess formed on a surface of at least one of said head of said rivet and said caulked leading end portion of said shaft of said rivet for guiding a drill for cutting said rivet when said first and second members are disassembled, wherein said guiding recess is formed simultaneously with caulking of said rivet.

2. A composite part for an electronic musical instrument according to claim 1, wherein said first and second members are made of materials different from each other.

3. A composite part for an electronic musical instrument according to claim 2, wherein said composite part is a hammer provided for each key of an electronic piano, said first member comprises a hammer body made of synthetic resin, and said second member comprises a weight made of iron for adding a weight to said hammer body.

* * * * *